US007531999B2

(12) United States Patent
Chang

(10) Patent No.: US 7,531,999 B2
(45) Date of Patent: May 12, 2009

(54) STARTUP CIRCUIT AND STARTUP METHOD FOR BANDGAP VOLTAGE GENERATOR

(75) Inventor: Wien-Hua Chang, Tainan Hsien (TW)

(73) Assignee: Realtek Semiconductor Corp., HsinChu (TW)

( * ) Notice: Subject to any disclaimer, the term of this patent is extended or adjusted under 35 U.S.C. 154(b) by 262 days.

(21) Appl. No.: 11/552,529

(22) Filed: Oct. 25, 2006

(65) Prior Publication Data

US 2007/0096712 A1 May 3, 2007

Related U.S. Application Data

(60) Provisional application No. 60/596,874, filed on Oct. 27, 2005.

(51) Int. Cl.
*G05F 3/16* (2006.01)
*G05F 3/26* (2006.01)

(52) U.S. Cl. ..... 323/317; 323/314; 323/316; 323/901

(58) Field of Classification Search ..... 323/311, 323/312, 313, 314, 315, 316, 317; 327/539
See application file for complete search history.

(56) References Cited

U.S. PATENT DOCUMENTS 4,857,823 A 8/1989 Bitting
6,784,652 B1 8/2004 Aude
6,998,902 B2 * 2/2006 Sugimura ..... 327/539

OTHER PUBLICATIONS

Anonymous, "Bandgap Voltage and Current Reference Designer" http://web.archive.org/web/20040807002920/ http://www.circuitsage.com/bandgap/bandgap.pdf, XP002417896, Aug. 7, 2004.
Rincon-Mora G. A, "Voltage References: From Diodes to Precision High-Order Bandgap Circuits passage", Wiley-Interscience, US, 2002, pp. 29-35, 43. XP002327208.

* cited by examiner

*Primary Examiner*—Gary L Laxton
(74) *Attorney, Agent, or Firm*—Winston Hsu

(57) ABSTRACT

A startup circuit for activating a bandgap circuit is provided, including a switching circuit, an activating circuit, and a controlling circuit. The controlling circuit is used for monitoring and comparing two voltages to determine whether the switching circuit should be turned on so as to activate the bandgap circuit. One of the two voltages that are monitored is a zero temperature coefficient voltage, and the other of the two voltages that are monitored is a negative temperature coefficient voltage.

18 Claims, 3 Drawing Sheets

STARTUP CIRCUIT AND STARTUP METHOD FOR BANDGAP VOLTAGE GENERATOR

CROSS REFERENCE TO RELATED APPLICATIONS

This application claims the benefit of U.S. Provisional Application No. 60/596,874, which was filed on Oct. 27, 2005 and is included herein by reference.

BACKGROUND OF THE INVENTION

1. Field of the Invention

The present invention relates to a startup circuit, and more particularly to a startup circuit applied in a bandgap voltage generator.

2. Description of the Prior Art

Conventionally, a bandgap voltage generator is utilized for generating a precise voltage and reference voltage, where the voltage should be a fixed voltage that is unaffected by the environment temperature. A startup circuit is coupled to the bandgap voltage generator for activating the bandgap voltage generator. After the bandgap voltage is generated, the startup circuit will be turned off automatically in order to reduce power consumption.

Please refer to FIG. 1. FIG. 1 is a diagram illustrating a prior art startup circuit 110. The startup circuit 110 is utilized in a bandgap voltage generator 100. If an error has occurred in the turn on time and the turn off time in the startup circuit 110, the bandgap voltage generator 100 will not operate properly. For example, if transistor $M_1$ of the startup circuit 110 is turned off (i.e. the voltage at terminal C is smaller than the threshold voltage $V_{th}$ of the transistor $M_1$), but the BJT transistor $Q_1$ of the bandgap voltage generator 100 is not turned on yet (i.e. the voltage $V_{in}$ at the terminal A is smaller than the base-emitter voltage $V_{be}$ of the transistor $Q_1$), then misjudging of the bandgap voltage generator 100 will occurred. On the other hand, if transistors $Q_1$ and $Q_2$ of the bandgap voltage generator 100 are turned on (i.e. the voltages Vin, Vip at the terminals A, B are larger than the base-emitter $V_{be}$ of the transistors $Q_1$ and Q2, respectively), but the transistor $M_1$ of the startup circuit 110 is not turned off (i.e. the voltage at the terminal C is larger than the threshold voltage $V_{th}$ of the transistor $M_1$), the startup circuit 110 will affect the biasing condition of the bandgap voltage generator 100, in which an error bandgap voltage is generated. Therefore, in order to avoid the above-mentioned problem, the startup circuit 110 should satisfy the following two equations:

$$V_{DD} - I_{M3} \cdot R_1 < V_{in}, \tag{1}$$

$$\frac{V_{be}}{R_2} + \frac{\ln(n) \cdot V_T}{R_3} > I_{M3} > \frac{V_{be}}{R_2}. \tag{2}$$

According to the equations (1) and (2), the resistor $R_1$ and the current $I_{M3}$ of the startup circuit 110 should be kept within a predetermined range to guarantee the normal operation of the bandgap voltage generator 100. Therefore, the startup circuit 110 should be well designed to conform to the variation of the bandgap voltage generator 100.

SUMMARY OF THE INVENTION

One of the objectives of the present invention is to provide a startup circuit, a bandgap voltage generator utilizing the startup circuit, and a startup method of the bandgap voltage generator to solve the above-mentioned problem.

According to an embodiment of the present invention, a startup circuit is disclosed. The startup circuit is utilized for activating a bandgap voltage generator, wherein the bandgap voltage generator comprises a first terminal for providing a first voltage level and a second terminal for providing a second voltage level. The startup circuit comprises a switching circuit, an activating circuit, and a controlling circuit. The switching circuit is coupled to the bandgap voltage generator; the activating circuit is coupled to the switching circuit for conducting the switching circuit to activate the bandgap voltage generator; and the controlling circuit is coupled to the switching circuit for monitoring the variation of the first voltage level and the second voltage level to control the conductivity of the switching circuit.

According to an embodiment of the present invention, a bandgap voltage generating circuit is disclosed. The bandgap voltage generating circuit comprises a bandgap voltage generator and a startup circuit. The bandgap voltage generator has a first terminal for providing a first voltage level and a second terminal for providing a second voltage level. The startup circuit is utilized for activating the bandgap voltage generator, and the startup circuit comprises: a switching circuit, an activating circuit, and a controlling circuit. The switching circuit is coupled to the bandgap voltage generator; the activating circuit is coupled to the switching circuit for conducting the switching circuit to activate the bandgap voltage generator; and the controlling circuit is coupled to the switching circuit for monitoring the variation of the first voltage level and the second voltage level to control the conductivity of the switching circuit.

According to an embodiment of the present invention, a startup method is disclosed. The startup method is utilized in a bandgap voltage generator, wherein the bandgap voltage generator comprises a first terminal for providing a first voltage level and a second terminal for providing a second voltage level, the startup method comprising: providing a switching circuit, coupled to the bandgap voltage generator; receiving an operating voltage level for conducting the switching circuit to activate the bandgap voltage generator; and monitoring the variation of the first voltage level and the second voltage level to control the conductivity of the switching circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
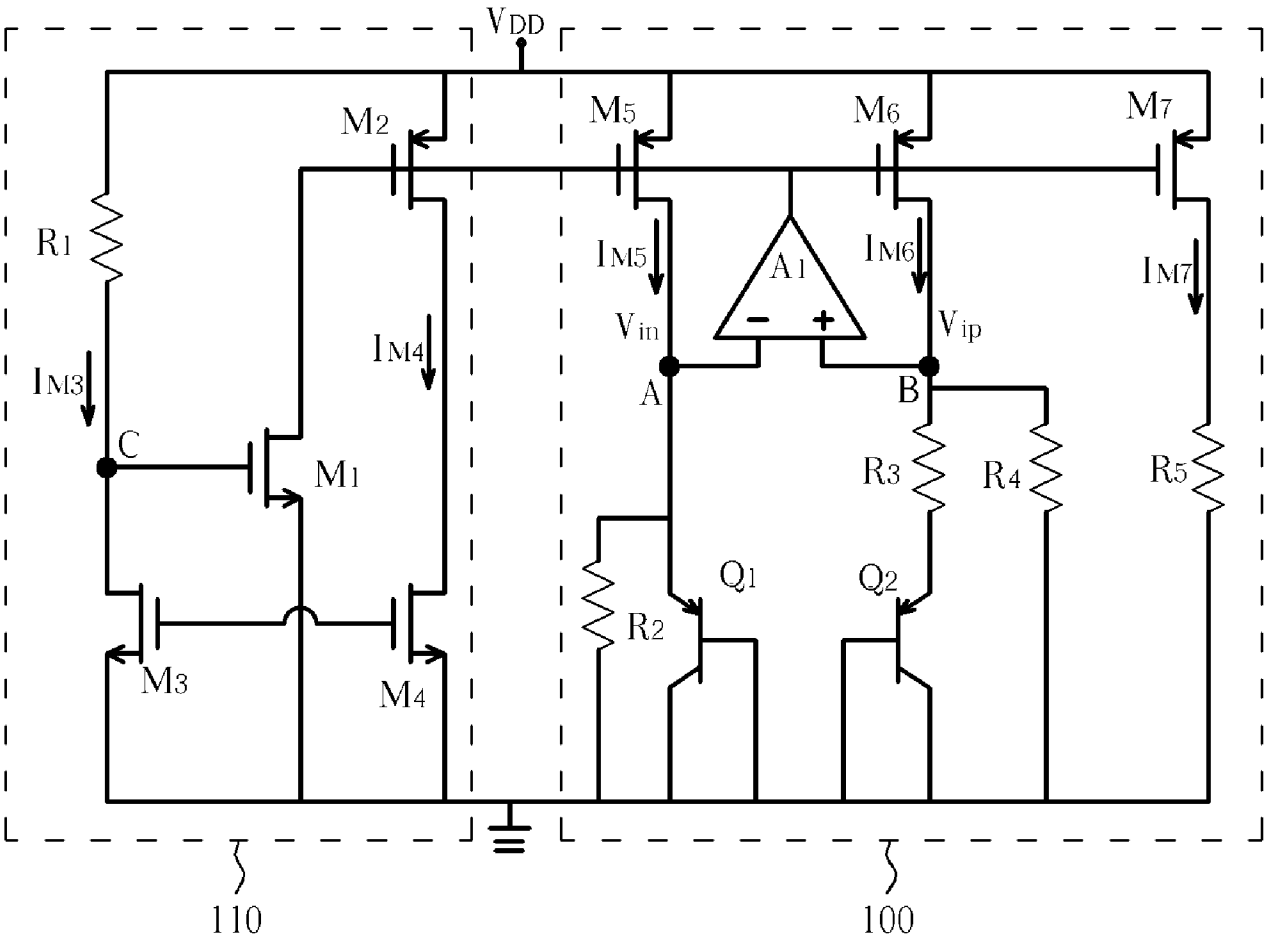
FIG. 1 is a diagram illustrating a prior art startup circuit.
Figure 2:
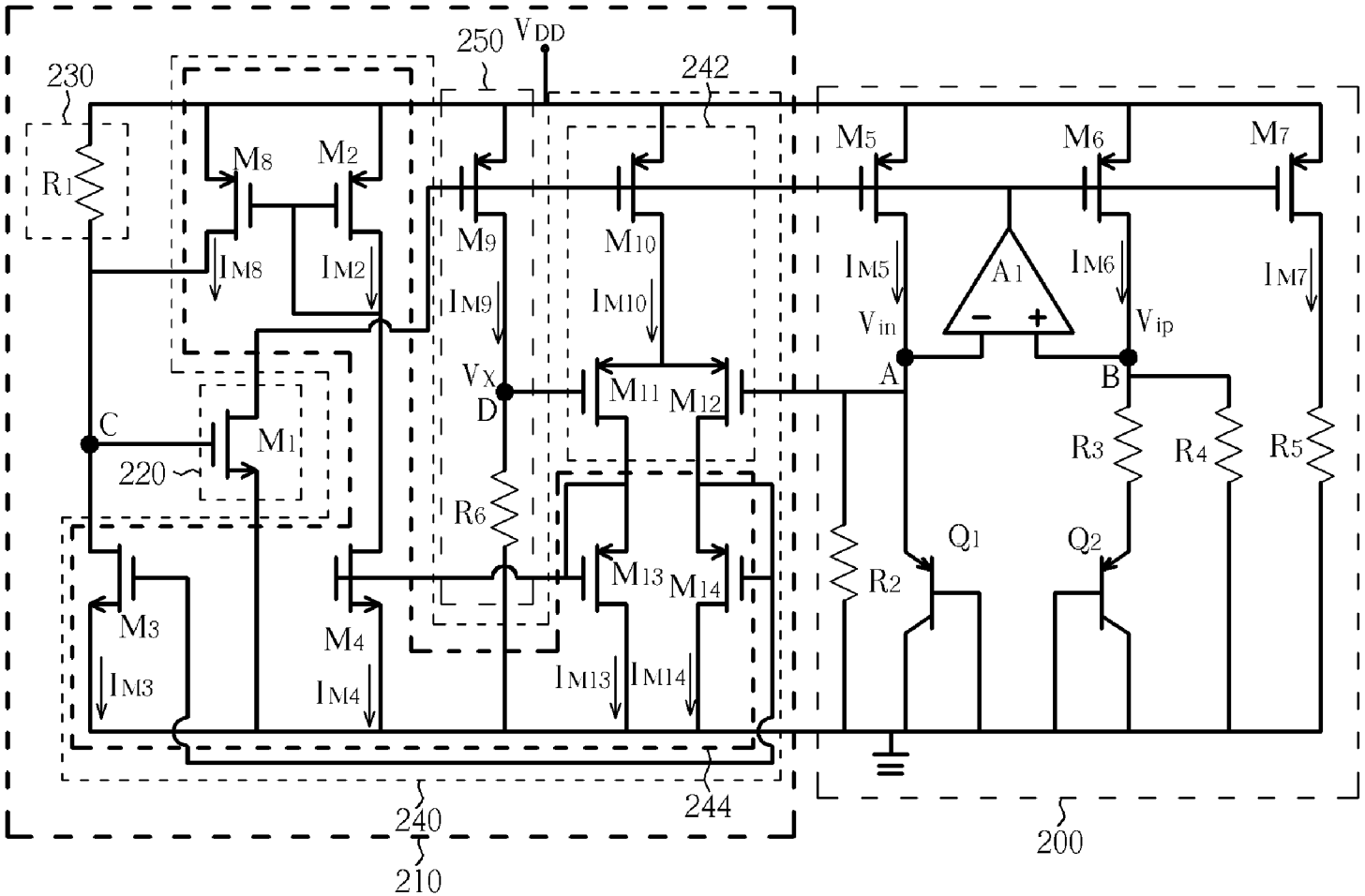
FIG. 2 is a schematic diagram illustrating the startup circuit of an embodiment of the present invention.

Please refer to FIG. 2. FIG. 2 is a schematic diagram illustrating a startup circuit 210 according to an embodiment of the present invention. The startup circuit 210 comprises a switching circuit 220, an activating circuit 230, a controlling circuit 240, and a referent circuit 250. The controlling circuit 240 comprises a differential circuit 242 and a current mirror module 244, wherein the switching circuit 220 comprises a transistor $M_1$; the activating circuit 230 comprises a resistor $R_1$; the differential circuit 242 comprises transistors $M_{10}$~$M_{12}$; the current mirror module 244 comprises transistors $M_2$~$M_4$, $M_8$, $M_{13}$ and $M_{14}$; and the referent circuit 250 comprises transistor $M_9$ and resistor $R_6$. Please note that a bandgap voltage generator 200 in FIG. 2 can be implemented by any circuit configuration that is able to generate the bandgap voltage, and both theory and operation of the bandgap voltage generator are prior art, and therefore omitted here for brevity. According to this embodiment of the present invention, the transistors $M_5$~$M_7$ of the bandgap voltage generator 200 are the same as the transistors $M_9$ and $M_{10}$; and the resistors $R_2$, $R_4$, and $R_6$ have the same resistance level. Furthermore, the transistor $M_{11}$ is the same as the transistor $M_{12}$; the transistors $M_3$, $M_4$, $M_{13}$, $M_{14}$ have the same specification; and the aspect ratio of the transistor $M_8$ is 1.5 times the aspect ratio of the transistor $M_2$.

When the startup circuit 210 begins to operate, the resistor $R_1$ in the activating circuit 230 adjusts the voltage at terminal C to approach an operating voltage level $V_{DD}$ according to the operating voltage level $V_{DD}$, and then turns on the transistor $M_1$. When the transistor $M_1$ is turned on, the drain voltage of the transistor $M_1$ will turn on the transistors $M_5$, $M_6$, $M_7$, $M_9$, and $M_{10}$ to form a current source circuit. Accordingly, all of the transistors in the controlling circuit 240 can be turned on to form a push-pull comparator. In FIG. 2, before the transistors $Q_1$ and $Q_2$ in the bandgap voltage generator 200 are turned on, the voltages $V_{in}$, $V_{ip}$, and $V_x$ at the terminals A, B, and D respectively are the same (because $I_{M9}=I_{M5}=I_{M6}$), where the voltage $V_x$ at the terminal D that is generated by the referent circuit 250 can be a referent voltage, in which the value of the referent voltage is equal to the voltages at terminals A and B of the bandgap voltage generator 200. Furthermore, due to the current mirroring relationship between the current $I_{M8}$ and the current $I_{M2}$, the current $I_{M8}$ is 1.5 times the current $I_{M3}$. Accordingly, the voltage at the terminal C is kept near the operating voltage level $V_{DD}$ to keep the transistor $M_1$ of the switching circuit 220 in an on condition, i.e. the current $I_{M8}$ is utilized for increasing the voltage level of the control terminal of the transistor $M_1$. The current supply of the bandgap voltage generator 200 continues to supply current to make the voltage $V_{in}$ at the terminal A be higher than the different voltage $V_{be}$ between the base and emitter of the transistor $Q_1$, for turning on the transistor $Q_1$; then the current $I_{M5}$ that originally passed through the resistor $R_2$ will be divided so a part of the current flows to the transistor $Q_1$ (BJT). Accordingly, the voltage $V_{in}$ at the terminal A is lower than the voltage $V_x$ at the terminal D. In other words, the voltage $V_x$ at terminal D that is generated by the referent circuit 250 corresponding to the voltage $V_{ip}$ at the terminal B of the bandgap voltage generator 200 (i.e. the voltage on resistor R 3 in the bandgap voltage generator 200 is a positive temperature coefficient voltage device), the voltage $V_x$ at terminal D is a substantially zero temperature coefficient voltage of the bandgap voltage generator 200, and the voltage $V_{in}$ at terminal A is the negative temperature coefficient voltage of the bandgap voltage generator 200. Therefore, the transistors $M_{10}$~$M_{12}$ of the differential circuit 242 vary the currents that pass through the transistor $M_{13}$ and $M_{14}$ and this is caused by both the above-mentioned positive and negative temperature coefficient voltages. In this embodiment, the current $I_{M13}$ that passes through the transistor $M_{13}$ is represented by the following equation:

$$I_{M13} \cong \frac{1}{2} I_{M10} - gm(M11, M12)(V_x - V_{in}), \tag{3}$$

and the current $I_{M14}$ that passes through the transistor $M_{14}$ is represented by the following equation:

$$I_{M14} \cong \frac{1}{2} I_{M10} + gm(M11, M12)(V_x - V_{in}). \tag{4}$$

In the current mirror module 244, the transistors $M_{13}$ and $M_4$ form a current mirror; the transistors $M_{14}$ and $M_3$ form a current mirror; and the transistors $M_2$ and $M_8$ form a current mirror. Therefore, the current $I_{M13}$ that flows through the transistor $M_{13}$ is equal to the current $I_{M4}$ that flows through the transistor $M_4$ (i.e. $I_{M13}=I_{M4}$); and the current $I_{M14}$ that flows through the transistor $M_{14}$ is equal to the current $I_{M3}$ that flows through the transistor $M_3$ (i.e. $I_{M3}=I_{M3}$). Furthermore, because the aspect ratio of the transistor $M_8$ is 1.5 times the aspect ratio of the transistor $M_2$, the current $I_{M8}$ that flows through the transistor $M_8$ is 1.5 times the current of the transistor $M_2$ (i.e. $I_{M8}=1.5*I_{M2}$). Accordingly, when the current $I_{M3}$ of the transistor $M_3$ is larger than the current $I_{M8}$ of the transistor $M_8$, the voltage at the terminal C will be pulled down into the ground voltage, and then turn off the transistor $M_1$ of the switching circuit 220; in other words, the current $I_{M3}$ is utilized for decreasing the voltage level of the control terminal of the transistor $M_1$. Accordingly, the condition to turn off the transistor $M_1$ is shown as below:

$$I_{M3}+gm(M11,M12)(V_x-V_{in})>1.5I_{M3}-gm(M11,M12)(V_x-V_{in}) \tag{5}$$

When the transistor M1 is turned off, the negative feedback loop formed by the operating amplifier $A_1$ of the bandgap voltage generator 200 can sustain the bandgap voltage generator 200 to operate under an appropriate circumstance. In the embodiment of the present invention, the resistor R1 and the current IM3 can be designed to a lager value according to requirements of the bandgap voltage generator 200 for overcoming the process variation.

Figure 3:
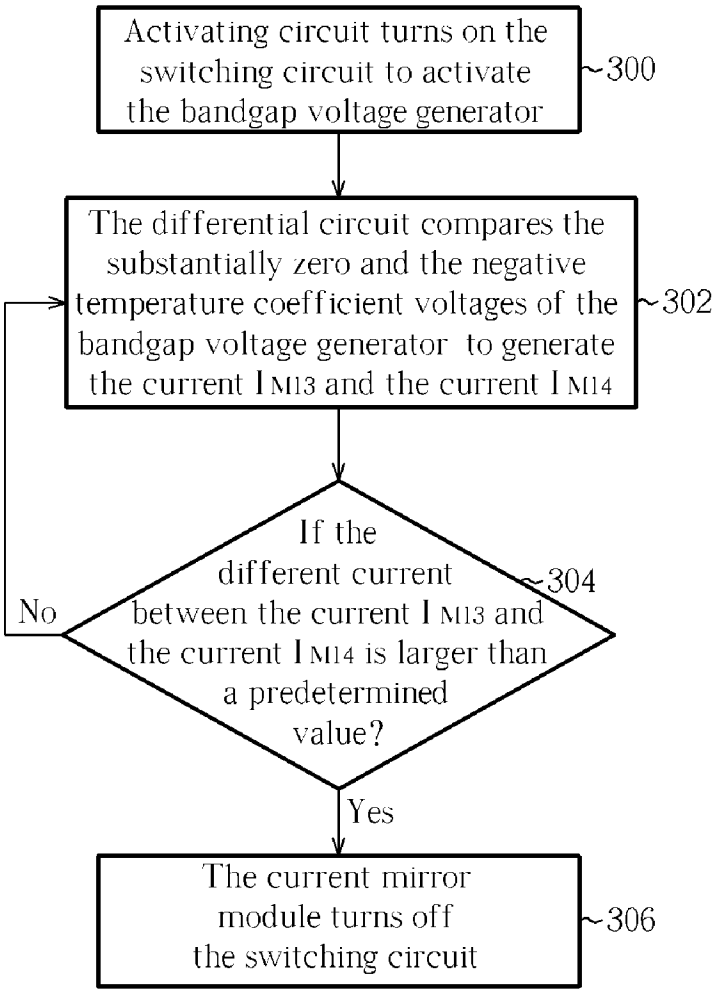
FIG. 3 is an operating flowchart of the startup circuit in FIG. 2.

Please refer to FIG. 3. FIG. 3 is an operating flowchart of the startup circuit 210 in FIG. 2. Please note that, provided that substantially the same result is achieved, the steps of the flowchart shown in FIG. 3 need not be in the exact order shown and need not be contiguous, that is, can include other intermediate steps. The steps of operating the startup circuit 210 are briefly listed as follows:

Step 300: Activating circuit 230 turns on the switching circuit 220 to activate the bandgap voltage generator 200;

Step 302: The differential circuit 242 compares the substantially zero and the negative temperature coefficient voltages of the bandgap voltage generator 200 to generate the current $I_{M13}$ and the current $I_{M14}$;

Step 304: The current mirror module 244 determines the conductivity of the switching circuit 220 according to the different current between the current $I_{M13}$ and the current $I_{M14}$; if the different current between the current $I_{M13}$ and the current $I_{M14}$ is larger than a predetermined value, go to step 306; otherwise, go to step 302;

Step 306: The current mirror module 244 turns off the switching circuit 220.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A startup circuit, for activating a bandgap voltage generator, the bandgap voltage generator comprising a first terminal for providing a first voltage level and a second terminal for providing a second voltage level, the startup circuit comprising:

a switching circuit, coupled to the bandgap voltage generator;

an activating circuit, coupled to the switching circuit, for conducting the switching circuit to activate the bandgap voltage generator; and a controlling circuit, coupled to the switching circuit, for monitoring the variation of the first voltage level and the second voltage level to control the conductivity of the switching circuits;

wherein the controlling circuit comprises:

a differential circuit, coupled to the first terminal, for generating a first output current and a second output current at a first output terminal and a second output terminal respectively according to the second voltage level and the first voltage level;

wherein the controlling circuit controls the conductivity of the switching circuit according to the first output current and the second output current.

2. The startup circuit of claim 1, wherein the second voltage level corresponds to a substantially zero temperature coefficient, and the first voltage level corresponds to a negative temperature coefficient.

3. The startup circuit of claim 1, further comprising:

a referent circuit, coupled to a first input terminal of the controlling circuit, for providing a referent voltage, wherein the referent voltage corresponds to the second voltage level, and a second input terminal of the controlling circuit is coupled to the first terminal.

4. The startup circuit of claim 1, wherein the differential circuit comprises:

a first transistor, having a control terminal coupled to the switching circuit, and a first terminal coupled to an operating voltage level;

a second transistor, having a control terminal coupled to the first voltage level, a first terminal coupled to a second terminal of the first transistor, and a second terminal being the first output terminal of the differential circuit; and a third transistor, having a control terminal coupled to a referent voltage, a first terminal coupled to the second terminal of the first transistor, and a second terminal being the second output terminal of the different circuit, wherein the referent voltage corresponds to the second voltage level.

5. The startup circuit of claim 1, wherein the activating circuit is an impedance device.

6. The startup circuit of claim 1, wherein the controlling circuit further comprises:

a current mirror module, coupled to the differential circuit and the switching circuit, for generating a first mirroring current and a second mirroring current according to the first output current and the second output current respectively, to control the conductivity of the switching circuit.

7. The startup circuit of claim 6, wherein the current mirror module comprises:

a first current mirror, coupled to the first output terminal and a control terminal of the switching circuit, for generating the first mirroring current according to the first output current;

a second current mirror, coupled to the control terminal of the switching circuit, for generating the second mirroring current according to a third mirroring current; and a third current mirror, coupled to the second output terminal and the second current mirror, for generating the third mirroring current according to the second output current;

wherein one of the first and the second mirroring currents is utilized for increasing the voltage level of the control terminal of the switching circuit, and the other mirroring current is utilized for decreasing the voltage level of the control terminal of the switching circuit.

8. The startup circuit of claim 7, wherein aspect ratios of the transistors in the second current mirror are different.

9. The startup circuit of claim 8, wherein aspect ratios of the transistors in the first and the third current mirrors are the same.

10. A startup method, for being utilized in a bandgap voltage generator, the bandgap voltage generator comprising a first terminal for providing a first voltage level and a second terminal for providing a second voltage level, the startup method comprising:

providing a switching circuit, coupled to the bandgap voltage generator;

receiving an operating voltage level to conduct the switching circuit to activate the bandgap voltage generator; and monitoring the variation of the first voltage level and the second voltage level to control the conductivity of the switching circuit;

wherein the step of monitoring the variation of the first voltage level and the second voltage level further comprises:

outputting a first output current and a second output current according to the second voltage level and the first voltage level, respectively; and controlling the conductivity of the switching circuit according to the first output current and the second output current.

11. The startup method of claim 10, wherein the second voltage level corresponds to a substantially zero temperature coefficient, and the first voltage level corresponds to a negative temperature coefficient.

12. The startup method of claim 10, wherein the step of monitoring the variation of the first voltage level and the second voltage level comprises:

comparing the first voltage level and the second voltage level to determine the conductivity of the switching circuit.

13. The startup method of claim 10, wherein the step of controlling the conductivity of the switching circuit according to the first output current and the second output current further comprises:

outputting a first mirroring current and a second mirroring current according to the first output current and the second output current respectively; and controlling the conductivity of the switching circuit according to the first mirroring current and the second mirroring current.

14. The startup method of claim 10, wherein the step of controlling the conductivity of the switching circuit according to the first output current and the second output current further comprises:

generating the first mirroring current according to the first output current;

generating the second mirroring current according to a third mirroring current; and generating the third mirroring current according to the second output current;

wherein one of the first and the second mirroring currents is utilized for increasing the voltage level of the control terminal of the switching circuit, and the other mirroring current is utilized for decreasing the voltage level of the control terminal of the switching circuit.

15. A bandgap voltage generating circuit, comprising:

a bandgap voltage generator having a first current pass for generating a first voltage; and a startup circuit, for activating the bandgap voltage generator, the startup circuit comprising:

a switching circuit, for determining the operation of the startup circuit;

a second current pass for generating a second voltage; and a detecting unit, having a differential pair for receiving the first voltage and the second voltage, for detecting the first voltage and the second voltage to control the switching circuit;

wherein the detecting unit comprises:

a differential circuit, for generating a first output current and a second output current at respectively according to the first voltage and the second voltage;

wherein the detecting unit controls the conductivity of the switching circuit according to the first output current and the second output current.

16. The bandgap voltage generating circuit of claim 15, wherein the second voltage is corresponding to a substantially zero temperature coefficient, and the first voltage level is corresponding to a negative temperature coefficient.

17. The bandgap voltage generating circuit of claim 15, wherein the first voltage is generated on a first resistor and the second voltage is generated on a second resistor.

18. The bandgap voltage generating circuit of claim 15, wherein the detecting unit comprises a push-pull comparator.

* * * * *